US009428701B2

(12) United States Patent
Matsuzawa et al.

(10) Patent No.: US 9,428,701 B2
(45) Date of Patent: Aug. 30, 2016

(54) FLUIDIZED-BED GASIFICATION METHOD AND FACILITY THEREFOR

(71) Applicant: IHI Corporation, Tokyo (JP)

(72) Inventors: Yoshiaki Matsuzawa, Tokyo (JP); Toshiyuki Suda, Tokyo (JP); Kenichiro Kondo, Tokyo (JP)

(73) Assignee: IHI CORPORATION, Tokyo (JP)

( * ) Notice: Subject to any disclaimer, the term of this patent is extended or adjusted under 35 U.S.C. 154(b) by 65 days.

(21) Appl. No.: 14/472,175

(22) Filed: Aug. 28, 2014

(65) Prior Publication Data

US 2014/0366447 A1 Dec. 18, 2014

Related U.S. Application Data

(62) Division of application No. 12/999,163, filed as application No. PCT/JP2009/002662 on Jun. 12, 2009, now Pat. No. 8,974,554.

(30) Foreign Application Priority Data

Jun. 20, 2008 (JP) ..... 2008-161747

(51) Int. Cl.
*C01B 3/36* (2006.01)
*C10J 3/46* (2006.01)
(Continued)

(52) U.S. Cl.
CPC ..... *C10J 3/463* (2013.01); *C10J 3/482* (2013.01); *C10J 3/56* (2013.01); *F23C 10/005* (2013.01); *F23C 10/10* (2013.01); *F23G 5/0276* (2013.01);
(Continued)

(58) Field of Classification Search
CPC ..... B01J 8/386; C10J 3/463; F23C 10/14; F23G 2203/502; F23G 5/30
See application file for complete search history.

(56) References Cited

U.S. PATENT DOCUMENTS 2,840,462 A 6/1958 Gorin
4,249,472 A 2/1981 Mitchell
(Continued)

FOREIGN PATENT DOCUMENTS

JP 2005-41959 2/2005
JP 2007-54793 3/2007
(Continued)

OTHER PUBLICATIONS

International Search Report issued in Patent Application No. PCT/JP2009/002662 on Aug. 25, 2009.

*Primary Examiner* — Imran Akram
(74) *Attorney, Agent, or Firm* — Oblon, McClelland, Maier & Neustadt, L.L.P

(57) ABSTRACT

A fluidized-bed gasification method using fluidized-bed combustion furnace; a separator for separation into bed material and an exhaust gas; a fluidized-bed gasification furnace into which the bed material is introduced through a downcomer and into which raw material is introduced; a circulation passage for circulating char and the bed material to the combustion furnace; a dispersion section; extending along a width of a bed-material-introduction-side wall of the gasification furnace to receive the bed material from the downcomer; a fluidizing-gas introduction system for blowing fluidizing gas into the dispersion section to fluidize the bed material in the dispersion section; and a supply section for supplying the bed material in the dispersion section to the fluidized-bed gasification furnace substantially evenly throughout the width on the bed-material-introduction side, is provided.

3 Claims, 7 Drawing Sheets

(51) Int. Cl.

| | |
|---|---|
| ***C10J 3/48*** | (2006.01) |
| ***F23C 10/00*** | (2006.01) |
| ***F23C 10/10*** | (2006.01) |
| ***F23G 5/027*** | (2006.01) |
| ***F23G 5/30*** | (2006.01) |
| ***F23G 7/00*** | (2006.01) |
| ***C10J 3/56*** | (2006.01) |

(52) U.S. Cl.

CPC ..... *F23G 5/30* (2013.01); *F23G 7/001* (2013.01); *C10J 2300/093* (2013.01); *C10J 2300/0976* (2013.01); *C10J 2300/0993* (2013.01); *C10J 2300/1637* (2013.01); *C10J 2300/1807* (2013.01); *C10J 2300/1853* (2013.01); *F23G 2201/304* (2013.01); *F23G 2201/40* (2013.01); *F23G 2203/501* (2013.01); *F23G 2203/503* (2013.01)

(56) References Cited

U.S. PATENT DOCUMENTS

| | | | |
|---|---|---|---|
| 4,405,339 | A | 9/1983 | Kunii |
| 4,490,157 | A | 12/1984 | Fernandes |
| 2009/0090053 | A1 | 4/2009 | Feldmann |
| 2009/0126271 | A1 | 5/2009 | Kyo et al. |
| 2009/0191104 | A1 | 7/2009 | Murakami et al. |
| 2010/0018121 | A1 | 1/2010 | Murakami et al. |
| 2010/0043683 | A1 | 2/2010 | Matsuzawa et al. |
| 2010/0101146 | A1 | 4/2010 | Fujimori et al. |
| 2010/0143208 | A1 | 6/2010 | Van Der Meijden et al. |

FOREIGN PATENT DOCUMENTS

| | | | | |
|---|---|---|---|---|
| JP | 2007-112873 | | 5/2007 | |
| WO | WO 2008102415 | A1 * | 8/2008 | ..... C10J 3/463 |
| WO | 2008/111127 | A1 | 9/2008 | |

* cited by examiner

FLUIDIZED-BED GASIFICATION METHOD AND FACILITY THEREFOR

CROSS-REFERENCE TO RELATED APPLICATIONS

This application is a division of U.S. application Ser. No. 12/999,163 filed Dec. 15, 2010, the entire contents of which is incorporated herein by reference. U.S. application Ser. No. 12/999,163 is a National Stage of PCT/JP09/002,662 filed Jun. 12, 2009 and claims the benefit of priority from prior Japanese Patent Application No. 2008-161747 filed Jun. 20, 2008.

TECHNICAL FIELD

The present invention relates to a fluidized-bed gasification method and a facility therefor for gasification of raw material, using a fluidized bed.

BACKGROUND ART

There has been proposed a fluidized-bed gasification facility for gasification of raw material such as coal, biomass or sludge wherein the raw material is supplied to a fluidized-bed gasification furnace preliminarily supplied with hot bed material or fluid medium, a gasification agent being supplied for formation of a fluidized bed to gasify the raw material, resultant produced gas being taken out outside while char produced upon the gasification in the gasification furnace and the bed material are supplied to a fluidized-bed combustion furnace to heat the bed material through fluidized combustion of the char, the heated bed material being supplied again to the fluidized-bed gasification furnace (see Patent Literature 1).

FIG. 1 shows a fluidized-bed gasification facility of the above Patent Literature 1. In FIG. 1, reference numeral 1 denotes a fluidized-bed combustion furnace into which char produced due to gasification of the raw material and the bed material in a fluidized-bed gasification furnace 2 is introduced through a lower portion of the combustion furnace, air from an air pipe 4 being blown through a bottom wind box 3. The char and bed material are fluidized and raised by the blown air; the char is burned and the bed material is heated while they are raised. Reference numeral 5 denotes a supplementary fuel port for supply of supplementary fuel to a fluidized bed in the fluidized-bed combustion furnace 1; and 6, a heat exchanger for heat recovery at a top of the combustion furnace 1.

Connected to the top of the combustion furnace 1 through a transfer pipe 7 is a separator 8 in the form of a cyclone and comprising outer and inner cylinders 9 and 10. Hot fluid including the bed material led out from the combustion furnace 1 to the transfer pipe 7 is tangentially introduced into the outer cylinder 9 where the fluid is centrifuged into the bed material and the exhaust gas. The exhaust gas with fine-grained ash is discharged through the inner cylinder 10 while the bed material 11 with rough-grained unburned char is supplied to the gasification furnace 2 via a downcomer 12 extending downward from a bottom of the outer cylinder in the separator 8.

The fluidized-bed gasification furnace 2 comprises an introduction section 13 into which the bed material 11 separated in the separator 8 is introduced through the downcomer 12, a gasification section 15 for gasification of raw material 26 supplied from a raw material feeder 14 by heat of the bed material 11, a communicating section 17 for supply of the bed material 11 in the introduction section 13 through a fluidized bed 16 to the gasification section 15 and a box section 18 extending over bottoms of the sections 13, 17 and 15 for supply of the gasification agent such as steam into the gasification furnace 2 and connected with a gasification agent supply line 19. The separation of the introduction and gasification sections 13 and 15 in the fluidized bed 16 by the communicating section 17 as shown in FIG. 1 prevents the burnt gas in the fluidized-bed combustion furnace 1 from flowing back through the fluidized-bed gasification furnace 2 to the separator 8.

The char not gasified in the gasification section 15 and the bed material are supplied for circulation to the fluidized-bed combustion furnace 1 via a circulation passage 25 comprising, for example, an overflow pipe, the bed material being heated again by the combustion of the char.

When coal is supplied as raw material 26 to be gasified to the gasification section 15, produced is produced gas 20 mixed with gas components such as hydrogen ($H_2$), carbon monoxide (CO) and methane ($CH_4$); when biomass or the like with a high water content is supplied as raw material 26 to be gasified, produced is produced gas 20 with the above-mentioned gas components containing much steam. The produced gas 20 is taken out via a take-out pipe 21 from the fluidized-bed gasification furnace 2 into a recovery device 22 where the produced gas 20 is separated from fine powder 23 entrained in the gas and is taken out through an inner pipe 24. The produced gas 20 thus taken out may be pressurized and supplied as fuel to, for example, a gas turbine, or may be supplied to a refinery for production of any target gas from the produced gas 20.

In order to guide the hot fluid from the fluidized bed combustion furnace 1 via the transfer pipe 7 to the separator 8, particles such as bed material entrained in the hot fluid must be prevented from being separated and accumulated in the transfer pipe 7 to clog the same; it is therefore envisaged that the separator 8 is arranged adjacent to the combustion furnace 1 to make the transfer pipe 7 as short in length as possible. In the construction of FIGS. 2 and 3, arranged above lateral corners of the fluidized-bed gasification furnace 2 adjacent to the fluidized-bed combustion furnace 1 are separators 8 and 8' connected respectively via short transfer pipes 7 and 7' to the combustion furnace 1 (see Patent Literature 2).

However, in the structure shown in FIGS. 2 and 3, the bed material 11 supplied via the downcomers 12 to the corners of the fluidized-bed gasification furnace 2 adjacent to the fluidized-bed combustion furnace 1 is allowed to flow in shortest courses 27 to the circulation passage 25, so that unreacted char flows out through the circulation passage 25 and a low-temperatured dead space 28 is produced in the gasification furnace 2 at a position away from the combustion furnace 1 where no bed material moves. This makes temperature in the fluidized-bed gasification furnace 2 uneven, disadvantageously resulting in lowering in gasification efficiency of the raw material 26 in the gasification furnace 2. In the above-mentioned fluidized-bed gasification facility shown in FIG. 1, the bed material 11 supplied through the downcomer 12 to the fluidized-bed gasification furnace 2 is allowed to flow in a shortest course to the circulation passage 25, so that low-temperatured dead spaces where no bed material 11 moves are produced on laterally opposite sides of the shortest course in the gasification furnace 2. As a result, like the structure of FIG. 2, the temperature in the fluidized-bed gasification furnace 2 becomes uneven, disadvantageously resulting in lowering in gasification efficiency of the raw material 26 in the fluidized-bed gasification furnace 2.

In order to overcome this, it has been conceived to provide a heat-resistant partition or partitions for regulation of a travel direction of the bed material 11 so as to move the bed material 11 to the dead space or spaces. In a structure shown in FIGS. 4 and 5, two heat-resistant partitions 32 are arranged in a laterally spaced-apart relationship and oppositely with respect to the circulation passage 25 such that the partitions 32 have their base ends firmly attached to a wall 29 of the gasification furnace 2 closest to the fluidized-bed combustion furnace 1 and have tip ends extending toward a wall 30 of the gasification furnace 2 farthest away from the combustion furnace 1 with communicating sections 31 therebetween. Thus, laterally symmetrical and substantially U-shaped circuitous flow passages 33 and 33' are provided in the fluidized-bed gasification furnace 2 which are partitioned by the partitions 32 and in communication with each other at the communicating sections 31. A separator 8 is arranged above a right-side end in the circuitous flow passage 33 close to the wall 29, and a separator 8' is arranged above a left-side end in the circuitous flow passage 33' close to the wall 29. A take-out port 34 is arranged above and centrally of the circuitous flow passages 33 and 33'.

When the bed material 11 is supplied through the downcomers 12 to the right- and left-side ends of the one and the other circuitous flow passages 33 and 33', respectively, the bed material 11 move through the respective circuitous flow passages 33 and 33' in a direction away from the fluidized-bed combustion furnace 1 and joins via the communicating sections 31 to each other at the central passage toward the circulation passage 25. As a result, the bed material 11 can be caused to pass every corner without lingering of the bed material 11 in the laterally opposite dead spaces to keep uniform the temperature in the fluidized-bed gasification furnace 2.

CITATION LIST

Patent Literature

Patent Literature 1: JP 2005-41959A
Patent Literature 2: WO 2008/111127A

SUMMARY OF INVENTION

Technical Problems

However, as throughput of the coal or other raw material is increased, the flow rate of the bed material 11 used to heat the raw material in the fluidized-bed gasification furnace 2 is increased, which leads to increase in size of the gasification furnace 2 as well as further difficulty in passing the bed material 11 to every corner of the gasification furnace 2, failing to produce a desired gasification amount and resulting in discharge of unreacted char. When the movement of the bed material 11 is restricted by, for example, arranging the heatresistant partitions 32 in the fluidized-bed gasification furnace 2 as in the construction of FIGS. 4 and 5, disadvantageously the gasification furnace 2 becomes complicated in structure and production cost increases.

The invention was made in view of the above and has its object to provide a fluidized-bed gasification method and a facility therefor capable of properly causing a bed material to pass every corner of a fluidized-bed gasification furnace even if the gasification furnace is large-sized, and capable of simplifying the fluidized-bed gasification furnace.

Solution to Problems

The invention is directed to a fluidized-bed gasification method arranging a fluidized-bed combustion furnace where char is burned to heat a bed material, hot fluid from said fluidized-bed combustion furnace being separated by a separator into the bed material and an exhaust gas, the separated bed material being introduced through a downcomer into a fluidized-bed gasification furnace, a raw material being introduced into said fluidized-bed gasification furnace where the raw material is gasified in a fluidized bed fed with a gasifying agent and a resultant produced gas is taken out, char produced upon the gasification of the raw material and the bed material being circulated to said fluidized-bed combustion furnace to burn the char, said method comprising supplying the bed material from said downcomer to a dispersion section extending along a width of a bed-material-introduction-side wall of the fluidized-bed gasification furnace, blowing a fluidizing gas into the dispersion section to fluidize the bed material, and supplying the bed material in the dispersion section into the fluidized-bed gasification furnace substantially evenly throughout the width on a bed-material-introduction side.

The invention is directed to a fluidized-bed gasification facility comprising a fluidized-bed combustion furnace where char is burned to heat a bed material, a separator for separation of hot fluid from said fluidized-bed combustion furnace into the bed material and an exhaust gas, a fluidized-bed gasification furnace into which the bed material separated in said separator is introduced via a downcomer, into which raw material is introduced and where the raw material is gasified by a fluidized bed fed with a gasifying agent and a produced gas is taken out, a circulation passage for circulation of char produced upon the gasification of the raw material in said fluidized-bed gasification furnace and the bed material to the fluidized-bed combustion furnace, a dispersion section extending along width of a bed-material-introduction-side wall constituting one of side surfaces of said fluidized-bed gasification furnace to receive the bed material from said downcomer, fluidizing-gas introduction means for blowing a fluidizing gas into said dispersion section to fluidize the bed material in the dispersion section, and a supply section for supplying the bed material in said dispersion section into the fluidized-bed gasification furnace substantially evenly throughout the width on a bed-material-introduction side.

In the fluidized-bed gasification facility of the invention, said circulation passage is arranged on a bed-material-lead-out-side wall of the fluidized-bed gasification furnace opposing to the bed-material-introduction-side wall.

In the fluidized-bed gasification facility of the invention, said supply section may comprise a plurality of supply pipes arranged along the width of the bed-material-introduction-side wall and leading from the dispersion section to the fluidized-bed gasification furnace.

In the fluidized-bed gasification facility of the invention, said supply section may comprise a supply passage having a supply port extending along the width of the bed-material-introduction-side wall and leading from the dispersion section to the fluidized-bed gasification furnace.

In the fluidized-bed gasification facility of the invention, said fluidizing-gas introduction means may comprise a plurality of fluidizing gas introduction pipes arranged along length of the dispersion section.

In the fluidized-bed gasification facility of the invention, said downcomer may have a lower opening positioned in the bed material in the dispersion section so as to prevent burnt gas from flowing back from the dispersion section to the downcomer.

In the fluidized-bed gasification facility of the invention, said supply pipe may comprise an inlet portion extending downwardly from the dispersion section, an intermediate portion for changing an extensional direction from the inlet portion to accumulate the bed material for formation of a sealing zone for pressure and an outlet portion leading from the intermediate portion to the fluidized-bed gasification furnace so as to supply the bed material overflowed from said intermediate portion to the fluidized-bed gasification furnace, said sealing zone being configured to prevent burnt gas from flowing back from the fluidized-bed gasification furnace to the dispersion section.

In the fluidized-bed gasification facility of the invention, said downcomer may comprise an intermediate portion for changing an extension in direction from the separator to accumulate the bed material for formation of a sealing zone for pressure and an outlet portion leading from the changing portion to the dispersion section to supply the bed material overflowed from said intermediate portion to the dispersion section, said sealing zone being configured to prevent the burnt gas from flowing back from the dispersion section to over the downcomer.

In the fluidized-bed gasification facility of the invention, a communication section is arranged between said dispersion section and said supply passage to provide a flow passage with a width substantially same as that of the bed-material-introduction-side wall and leading from the dispersion section to the supply passage, said communicating section being formed by changing the extension in direction from the dispersion section to accumulate the bed material between the dispersion section and the supply passage for formation of a sealing zone for pressure, said sealing zone being configured to prevent the burnt gas from flowing back from the fluidized-bed gasification furnace to the dispersion section.

In the fluidized-bed gasification facility of the invention, the configuration may be such that the raw material is introduced into the fluidized-bed gasification furnace at plural positions.

When the bed material is to be supplied from said separator to the fluidized-bed gasification furnace, the bed material is introduced through said downcomer into the dispersion section extending along the width of the bed-material-introduction-side wall of the fluidized-bed gasification furnace, blowing a fluidizing gas from the fluidizing-gas introduction means into the dispersion section, fluidizing the bed material to evenly disperse the same in the dispersion section, supplying the bed material from said dispersion section to the fluidized-bed gasification furnace substantially evenly throughout the width on a bed-material-introduction side while reducing the lingering of the bed material in said fluidized-bed gasification furnace.

Advantageous Effects of Invention

According to a fluidized-bed gasification method and a facility therefor of the invention, the bed material is supplied into said fluidized-bed gasification furnace substantially evenly throughout the width on the bed-material-introduction side so that, even if said fluidized-bed gasification furnace is large sized, the bed material can be caused to pass every corner of the fluidized-bed gasification furnace, thereby attaining a desired gasification amount and preventing unreacted char from being discharged. Since the bed material is caused to pass substantially evenly in said fluidized-bed gasification furnace, it becomes unnecessary to provide a heat-resistant partition or partitions or the like in the fluidized-bed gasification furnace, which advantageously simplifies in structure the fluidized-bed gasification furnace and reduces a production cost.

DESCRIPTION OF EMBODIMENTS

Figure 1:
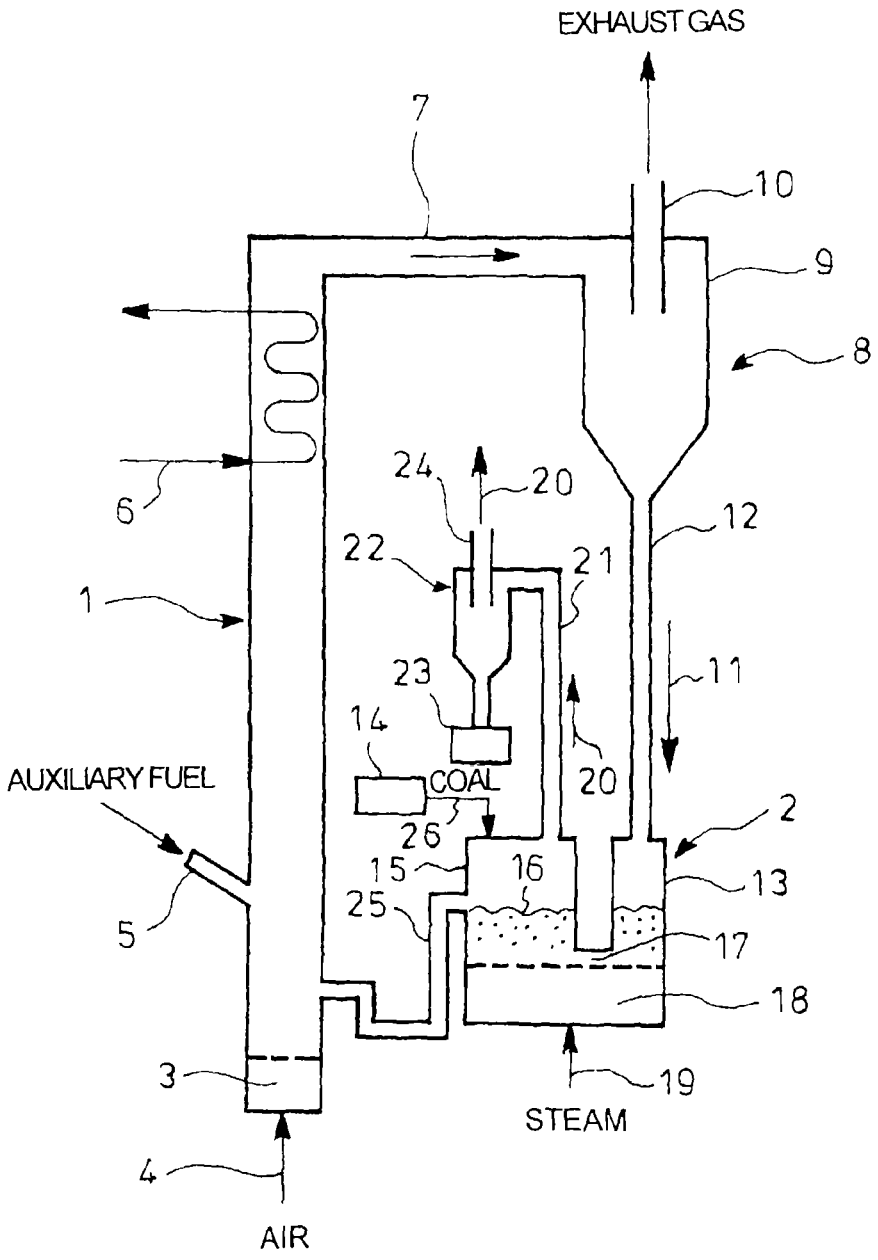
FIG. 1 is a side view showing a conventional fluidized-bed gasification facility.
Figure 2:
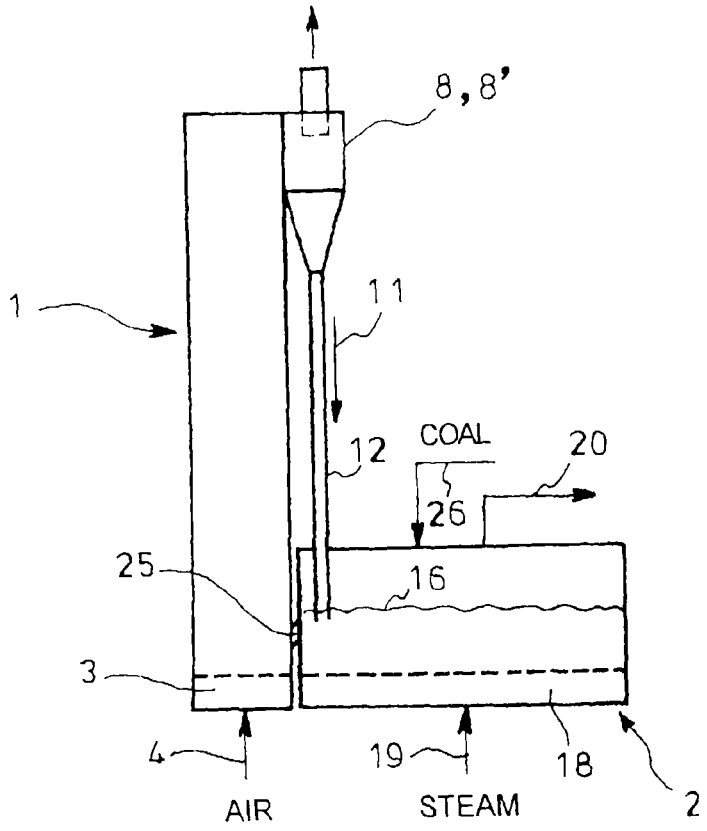
FIG. 2 is a side view showing a further conventional fluidized-bed gasification facility.
Figure 3:
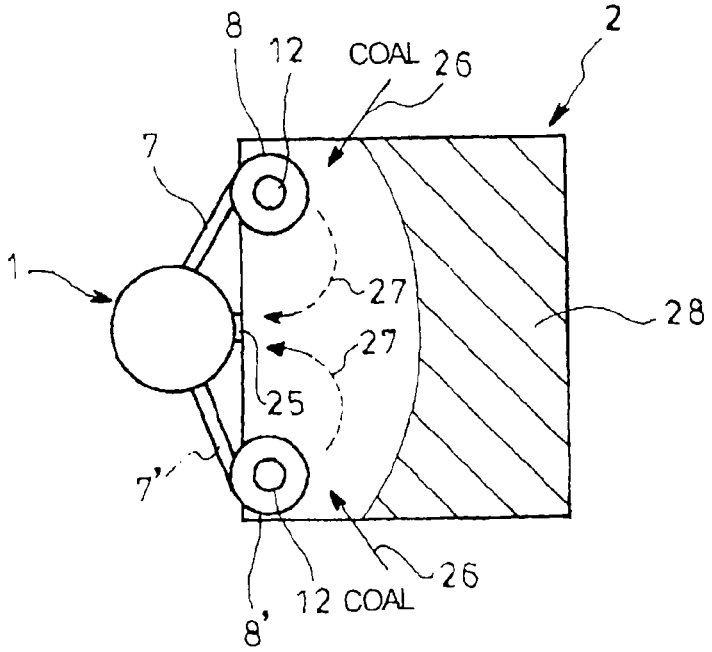
FIG. 3 is a plan view of FIG. 2.
Figure 4:
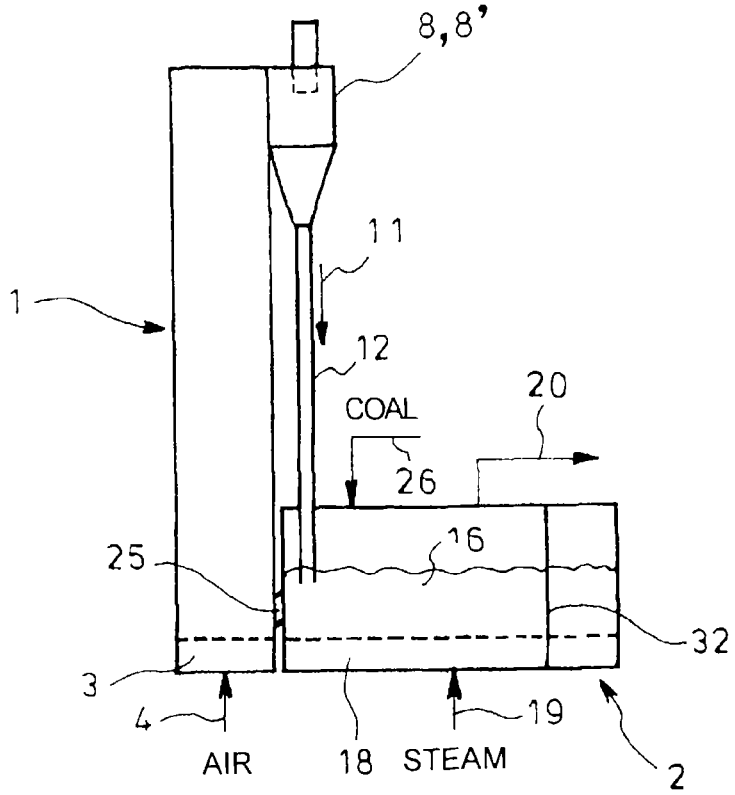
FIG. 4 is a side view showing a still further conventional fluidized-bed gasification facility.
Figure 5:
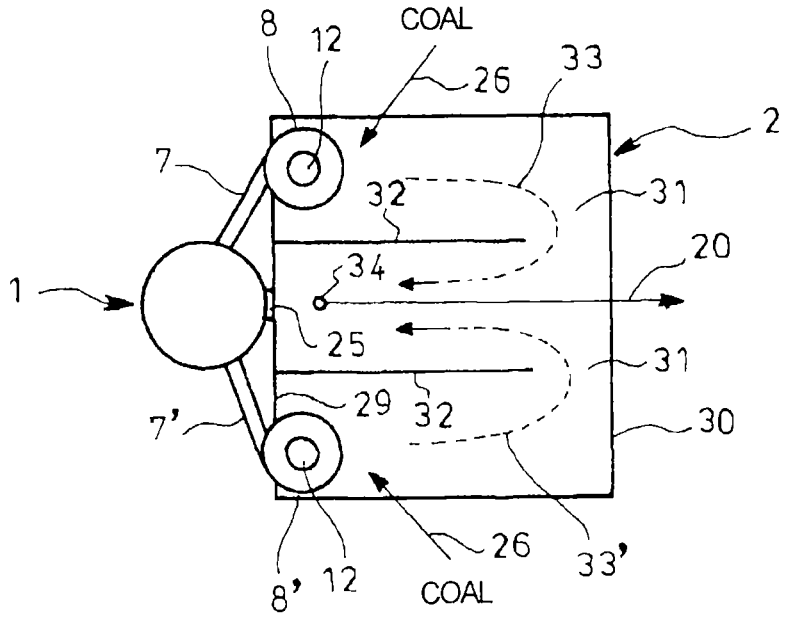
FIG. 5 is a plan view of FIG. 4.

A first embodiment of the invention will be described in conjunction with FIGS. 6 and 7.

Provided in the first embodiment are a fluidized-bed combustion furnace 1 in which char is burned to heat a bed material, a separator 8 in which the bed material 11 is separated from hot fluid from the combustion furnace 1 and a fluidized-bed gasification furnace 40 into which the bed material 11 separated in the separator 8 is introduced through a downcomer 46, into which a raw material 26 is introduced from a raw material feeder (not shown) in a raw material introduction section and to which a gasifying agent such as steam, air or carbon dioxide is supplied to form a fluidized bed 16. In the fluidized-bed gasification furnace 40, the raw material 26 is gasified by agitating the same with the hot bed material 11 and produced gas 20 is taken out through a produced gas takeout section (not shown). Char produced upon the gasification of the raw material in the gasification furnace 40 and the bed material 11 are circulated through a circulation passage 25 to the fluidized-bed combustion furnace 1. In the above, introduction of the raw material 26 into the fluidized-bed gasification furnace 40 is conducted upstream of the flow of the bed material to increase a reaction time of the raw material 26.

The fluidized-bed gasification furnace 40 has walls 41 and 42 away from and near the fluidized-bed combustion furnace 1 and serving as a bed-material-introduction-side wall through which the bed material 11 is introduced and as a bed-material-lead-out-side wall through which the bed material 11 is led out, respectively. Arranged above and adjacent to the bed-material-introduction-side wall 41 of the fluidized-bed gasification furnace 40 is a cylindrical dispersion section 43 extending along and having a length substantially same as a width of the wall 41. The dispersion section 43 is not restricted to a cylinder and may have a square or other three-dimensional shape.

The dispersion section 43 is internally partitioned by a partition 44 into an upper space for temporary storage of the bed material 11 from the downcomer 46 and a lower space serving as a wind box 45. The dispersion section 43 has a top connected to the downcomer 46 at a position centrally of the length of the section 43, a bottom having fluidizing-gas introduction means 47 arranged for introduction of fluidizing gas such as nitrogen, carbon dioxide or steam into the section 43 at plural positions, and a periphery with a supply section 48 connected to the fluidized-bed gasification furnace 40.

The downcomer 46 comprises a slant pipe 49 extending downwardly aslant from the separator 8 and connected to the dispersion section 43. A lower opening 50 of the downcomer 46 is positioned in the bed material 11 in the dispersion section 43 to form a sealing zone for breaking off a pressure relationship.

Figure 8:
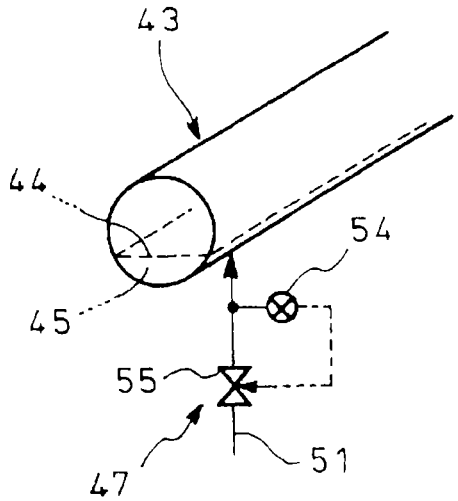
FIG. 8 is a schematic view showing a dispersion section provided with fluidizing gas introduction pipe and a wind box.
Figure 9:
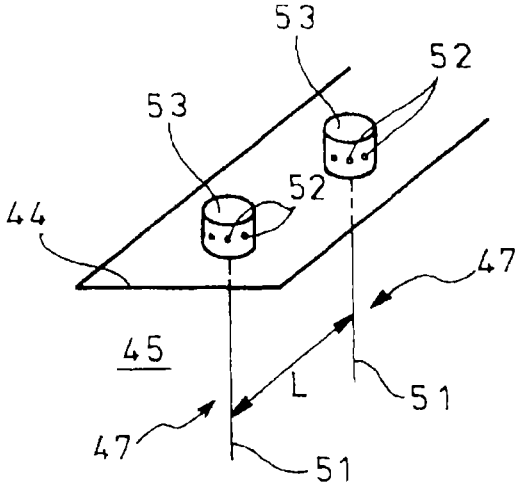
FIG. 9 is a schematic view showing fluidizing-gas introduction means in the dispersion section.
Figure 10:
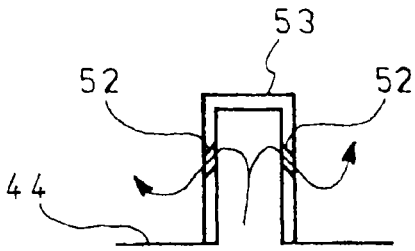
FIG. 10 is a schematic view showing blowout of the fluidizing gas from an introduction portion.

The fluidizing-gas introduction means 47 comprises, as shown in FIGS. 8 and 9, a plurality of fluidizing-gas introduction pipes 51 arranged on and along the length of the dispersion section 43 (the width of the bed-material-introduction-side wall 41) and spaced apart from each other by a constant spacing L of several to scores of centimeters. The partition 44 in the dispersion section 43 is provided with, as shown in FIG. 9, concave introduction sections 53 peripherally formed with fluidizing-gas introduction ports 52. The introduction ports 52 on the introduction sections 53 may be aslant downward from within to outside as shown in FIG. 10. Each of the fluidizing-gas introduction pipes 51 may be provided with, as shown in FIG. 8, a pressure gage or other sensor means 54 and an on/off valve or other on/off means 55 selectively opened and closed depending on data from the sensor means 54 to regulate a fluidized state of the bed material 11.

The supply section 48 comprises a plurality of supply pipes 56 arranged on the periphery of the dispersion section 43 on a side near the fluidized-bed gasification furnace 40 along the length of the section 43 and spaced apart from each other by a constant spacing of scores of centimeters to several meters. The plural supply pipes 56 extend downwardly from the dispersion section 43 and are connected to the fluidized-bed gasification furnace 40 with a predetermined spacing from each other along and throughout the width of the bed-material-introduction-side wall 41 of the furnace 40.

The supply means for supplying the coal or other raw material 26 to the fluidized-bed gasification furnace 40 may be such that a raw material supply pipe or pipes (not shown) extending from the raw material feeder or the like is or are connected to the dispersion section 43 at a position or positions so as to supply the raw material 26 to the section 43.

Further, a circulation passage 25 leading from the fluidized-bed gasification furnace 40 to the fluidized-bed combustion furnace 1 is arranged on the bed-material-lead-outside wall 42 of the furnace 40 opposing to the bed-material-introduction-side wall 41.

An operation of the first embodiment for the fluidized-bed gasification method and the facility therefor of the invention will be described.

When the bed material 11 is to be supplied from the separator 8 to the fluidized-bed gasification furnace 40, the bed material 11 is introduced through the downcomer 46 into the dispersion section 43 extending along the width of the bed-material-introduction-side wall 41 of the furnace 40. The fluidizing gas is blown from the fluidizing-gas introduction means 47 into the dispersion section 43 to fluidize and disperse evenly the bed material 11 into the dispersion section 43 without localized distribution of the bed material 11 due to a charged position from the downcomer 46. Then, the bed material 11 is supplied from the dispersion section 43 via the plural supply pipes of the supply section 48 to the fluidized-bed gasification furnace 40 evenly throughout the width on the bed-material-introduction side, thereby leading out the bed material 11 from the bed-material-lead-out side in the furnace 40 while reducing the lingering of the bed material 11 in the furnace 40.

Thus, according to the first embodiment of the fluidized-bed gasification method and the facility therefor, the bed material 11 is supplied to the fluidized-bed gasification furnace 40 evenly throughout the width on the fluidized-bed-introduction side, so that even if the gasification furnace 40 is larger-sized, the bed material 11 can be caused to pass every corner of the fluidized-bed gasification furnace 40, thereby attaining a desired gasification amount and preventing unreacted char from being discharged. Since the bed material 11 is caused to pass evenly in the fluidized-bed gasification furnace 40, it becomes unnecessary to provide a heat-resistant partition, partitions or the like in the fluidized-bed gasification furnace 40, which simplifies in structure the fluidized-bed gasification furnace 40, reduces a production cost and facilitates maintenance.

The dispersion section 43, which extends along and has the length substantially equal to the width of the bed-material-introduction-side wall 41 of the fluidized-bed gasification furnace 40, facilitates the supply of the bed material 11 evenly into the gasification furnace 40 throughout the width on the bed-material-introduction side, so that the bed material 11 can be caused to pass every corner of the gasification furnace 40, thereby properly attaining a desired gasification amount and easily preventing the unreacted char from being discharged.

The circulation passage 25, which is arranged on the bed-material-lead-out-side wall 42 of the fluidized-bed gasification furnace 40 opposite to the bed-material-introduction-side wall 41, facilitates the supply of the bed material 11 evenly into the gasification furnace 40 throughout the width on the bed-material-introduction side, so that the bed material 11 can be caused to pass every corner of the gasification furnace 40, thereby properly attaining a desired gasification amount and easily preventing the unreacted char from being discharged.

The supply section 48, which comprises the plural supply pipes 56 leading from the dispersion section 43 to the fluidized-bed gasification furnace 40 and arranged along the width of the bed-material-introduction-side wall 41, further facilitates the supply of the bed material 11 evenly into the gasification furnace 40 throughout the width on the bed-material-introduction side, so that the bed material 11 can be caused to pass every corner of the gasification furnace 40, thereby properly attaining a desired gasification amount and easily preventing the unreacted char from being discharged.

The fluidizing-gas introduction means 47, which comprises the plural fluidizing-gas introduction pipes 51 arranged along the length of the dispersion section 43 to blow the fluidizing gas into the dispersion section 43 and evenly disperse the same in the section 43 without localized dispersion due to the charged position of the bed material 11 from the downcomer 46, further facilitates the supply of the bed material 11 evenly into the fluidized-bed gasification furnace 40 throughout the width on the bed-material-introduction side, so that the bed material 11 can be caused to pass every corner of the fluidized-bed gasification furnace 40, thereby properly attaining a desired gasification amount and easily preventing the unreacted char from being discharged.

The downcomer 46, which has the lower opening 50 positioned in the bed material 11 in the dispersion section 43 for prevention of the burnt gas from flowing back from the dispersion section 43 to the downcomer 46, optimally supplies the bed material 11 from the dispersion section 43 through the supply pipes 56 to the fluidized-bed gasification furnace 40, so that the bed material 11 can be caused to pass every corner of the fluidized-bed gasification furnace 40, thereby properly attaining a desired gasification amount and easily preventing the unreacted char from being discharged.

Figure 6:
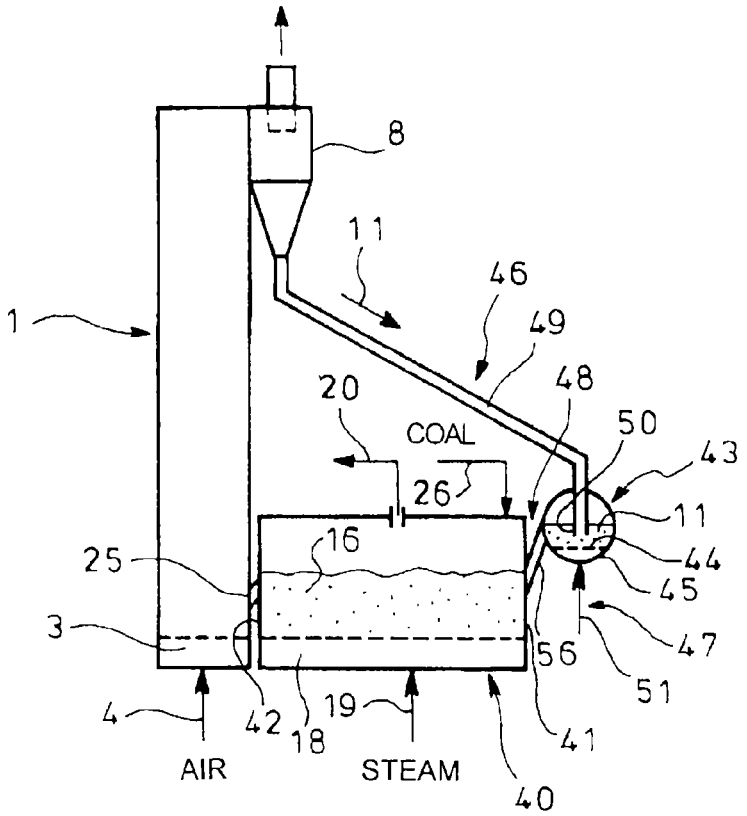
FIG. 6 is a side view showing a first embodiment of the invention.
Figure 7:
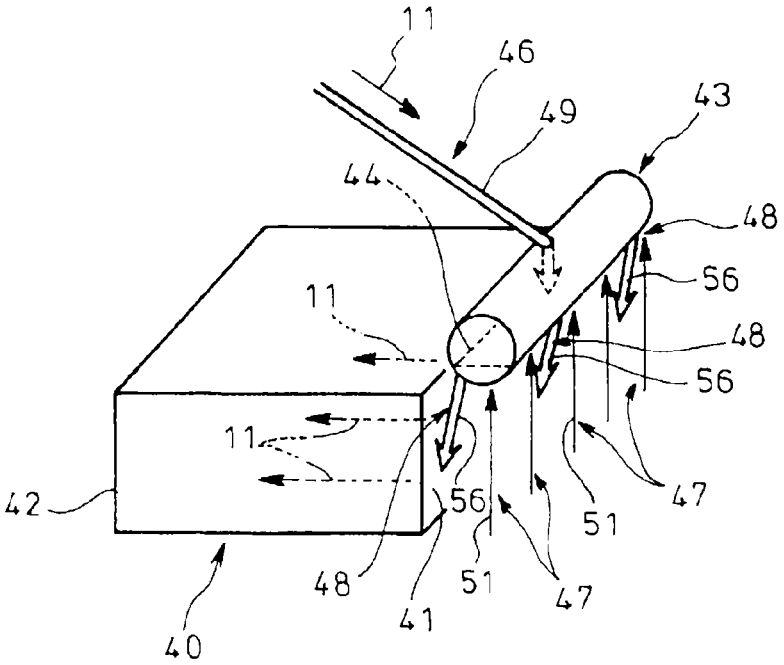
FIG. 7 is a schematic view showing flows of bed material and of fluidizing gas in the first embodiment of the invention.
Figure 11:
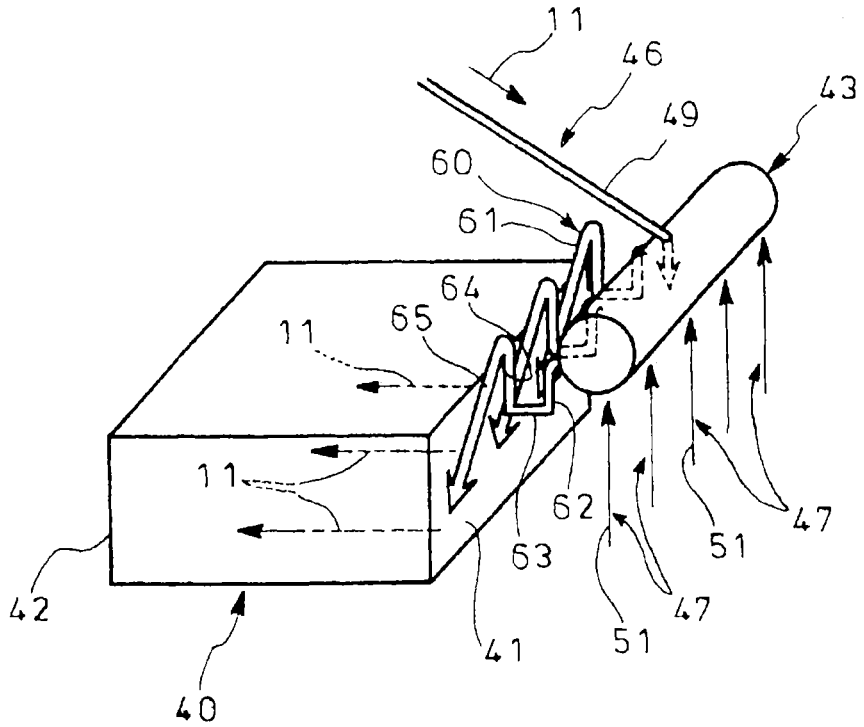
FIG. 11 is a schematic view showing flows of bed material and of fluidizing gas in a second embodiment of the invention.

A second embodiment of the invention will be described in conjunction with FIG. 11 where parts similar to those in FIGS. 6 and 7 are represented by the same reference numerals.

The second embodiment has a modification of the supply section 48 in the first embodiment. Specifically, a supply section 60 of the second embodiment comprises a plurality of supply pipes 61 arranged on a periphery of a dispersion section 43 on a side near a fluidized-bed gasification furnace 40 along a length of the section 43 (a width of a bed-material-introduction-side wall 41 of the furnace 40) and spaced apart from each other by a constant spacing of scores of centimeters to several meters; each of the supply pipes 61 comprises an inlet portion 62 extending downwardly from the dispersion section 43, a bottom intermediate portion 63 extending substantially horizontally from a lower end of the inlet portion 62 for change of an extension in direction from the inlet portion 62, a rising intermediate portion 64 extending upward from a tip of the bottom intermediate portion 63 and an outlet portion 65 extending from an upper end of the rising intermediate portion 64 to the gasification furnace 40, a bed material 11 being accumulated in the portions 62, 63 and 64 to form a sealing zone for pressure and being consistently fluidized by introducing fluidizing gas such as nitrogen, carbon dioxide or steam into the sealing zone. The plural supply pipes 61 are arranged with a predetermined spacing along the width of a bed-material-introduction-side wall 41 throughout the width on a bed-material-introduction side in the fluidized-bed gasification furnace 40. The inlet and intermediate portions 62, 63 and 64 may be of any shape, providing the sealing zone for pressure is formed.

The dispersion section 43 is of a shape substantially similar to that of the first embodiment and is internally partitioned by a partition 44 (see FIG. 8) into an upper space for temporary storage of a bed material 11 from a downcomer 46 and a lower space serving as a wind box 45. The dispersion section 43 has a top connected to the downcomer 46 at a position centrally of the length of the section 43 and a bottom having fluidizing-gas introduction means 47 arranged for introduction of the fluidizing gas such as nitrogen, carbon dioxide or steam into the section 43 at plural positions.

The downcomer 46 comprises a slant pipe 49 extending downward aslant from the separator 8 and connected to the dispersion section 43. A lower opening (not shown) of the downcomer 46 is positioned in the dispersion section 43 above the bed material 11.

Substantially like the first embodiment, the fluidizing-gas introduction means 47 comprises a plurality of fluidizing gas introduction pipes 51 arranged on and along the length of the dispersion section 43 and spaced apart from each other by a constant spacing L of several to scores of centimeters. As shown in FIGS. 8-10, the partition 44 in the dispersion section 43 is provided with concave introduction sections 53 peripherally formed with fluidizing-gas introduction ports 52. The introduction ports 52 on the introduction section 53 may be aslant downward from within to outside. Each of the fluidizing-gas introduction pipes 51 may be provided with a pressure gage or other sensor means 54 and an on/off valve or other on/off means 55 selectively opened and closed depending on data from the sensor means 54 to regulate a fluidized state of the bed material 11.

Supply means for supplying the raw material 26 such as coal into the fluidized-bed gasification furnace 40 may be such that a raw material supply pipe or pipes (not shown) extending from a raw material feeder or the like is or are connected to the dispersion section 43 so as to supply the raw material 26 to the section 43.

Further, a circulation passage 25 (see FIG. 6) leading from the fluidized-bed gasification furnace 40 to the fluidized-bed combustion furnace 1 is arranged on the bed-material-lead-out-side wall 42 of the furnace 40 opposing to the bed-material-introduction-side wall 41.

An operation of the second embodiment for the fluidized-bed gasification method and the facility therefor of the invention will be described.

When the bed material 11 is to be supplied from the separator 8 to the fluidized-bed gasification furnace 40, the bed material 11 is introduced through the downcomer 46 into the dispersion section 43 extending along the width of the bed-material-introduction-side wall 41 of the furnace 40. The fluidizing gas is blown from the fluidizing-gas introduction means 47 into the dispersion section 43 to evenly disperse the bed material 11 into the dispersion section 43 without localized distribution of the bed material 11 due to a charged position from the downcomer 46. Then, the bed material 11 is supplied from the dispersion section 43 via the plural supply pipes of the supply section 60 to the fluidized-bed gasification furnace 40 evenly throughout the width on the bed-material-introduction side, thereby leading out the bed material 11 from the bed-material-lead-out side of the furnace 40 while reducing the lingering of the bed material 11 in the furnace 40.

In this case, in the supply section 60, the bed material 11 is accumulated in the inlet and intermediate portions 62, 63 and 64 to form a sealing zone for pressure so as to prevent the burnt gas in the fluidized-bed gasification furnace 40 from flowing back into the dispersion section 43, the bed material 11 overflowed from the rising intermediate portion 64 being supplied via the outlet portion 65 to the furnace 40.

Thus, the second embodiment of the fluidized-bed gasification method and the facility therefor of the invention can exhibit effects and advantages substantially similar to those in the first embodiment. With the supply pipes 61 of the supply section 60 comprising the inlet portion 62 extending downward from the dispersion section 43, the intermediate portions 63 and 64 for change of an extension in direction of the inlet portion 62 to accumulate the bed material 11 for formation of a sealing zone for pressure and the outlet portion 65 leading from the intermediate portion 64 to the fluidized-bed gasification furnace 40 for supply of the bed material 11 overflowed from the rising intermediate portion 64 to the furnace 40, the sealing zone serving to prevent the burnt gas in the furnace 40 from flowing back into the dispersion section 43, the bed material 11 is optimally supplied from the dispersion section 43 via the supply pipes 61 to the furnace 40 and the bed material 11 can be caused to pass every corner of the furnace 40, thereby properly attaining a desired gasification amount and easily preventing the unreacted char from being discharged.

Figure 12:
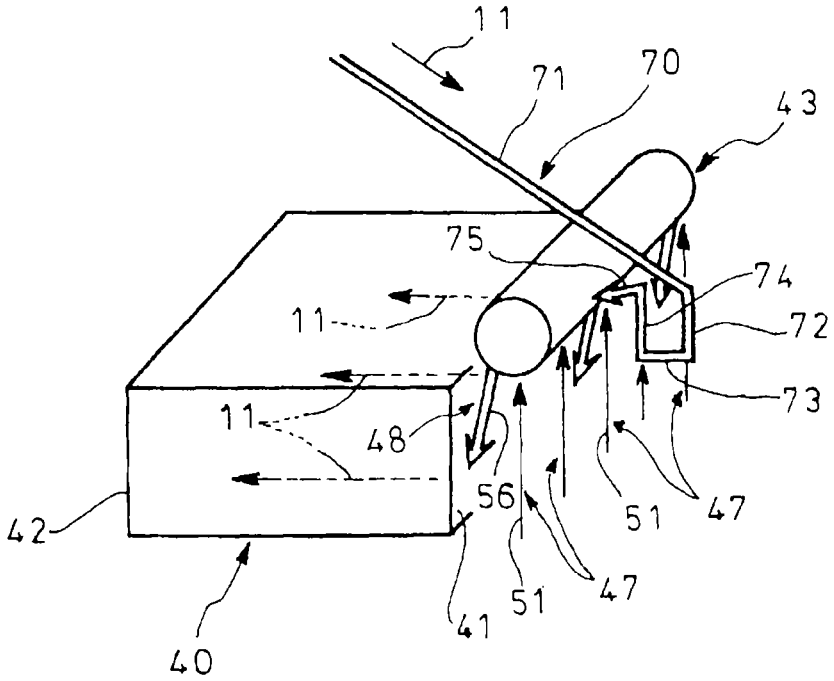
FIG. 12 is a schematic view showing flows of bed material and fluidizing gas in a third embodiment of the invention.

Next, a third embodiment of the invention will be described in conjunction with FIG. 12 where parts similar to those in FIGS. 6 and 7 are represented by the same reference numerals.

The third embodiment has a modification of the downcomer 46 in the first embodiment. Specifically, a downcomer 70 of the third embodiment comprises a slant pipe 71 extending aslant downward from the separator 8, a lowering intermediate portion 72 extending substantially vertically from a lower end of the slant pipe 71, a bottom intermediate portion 73 extending substantially horizontally from a lower end of the lowering intermediate portion 72, a rising intermediate portion 74 extending upward from a tip end of the bottom intermediate portion 73 and an outlet portion 75 extending from an upper end of the rising intermediate portion 74 and leading to the dispersion section 43, the bed material 11 being accumulated in the intermediate portions 72, 73 and 74 to form a sealing zone for pressure, the bed material 11 in the intermediate portions being consistently fluidized by introducing fluidizing gas such as nitrogen, carbon dioxide or steam into the sealing zone. The intermediate portions 72, 73 and 74 may be of any shape, providing the sealing zone for pressure is formed.

The dispersion section 43 is of a shape substantially similar to that of the first embodiment and is internally partitioned by a partition 44 (see FIG. 8) into an upper space for temporary storage of the bed material 11 supplied from a downcomer 46 to the fluidized-bed gasification furnace 40 and a lower space serving as a wind box 45. The dispersion section 43 has a bottom having fluidizing-gas introduction means 47 arranged for introduction of the fluidizing gas into the section 43 at a plurality of positions and a periphery with a supply section 48 connected to the fluidized-bed gasification furnace 40.

Substantially like the first embodiment, the fluidizing-gas introduction means 47 comprises a plurality of fluidizing gas introduction pipes 51 arranged on and along the length of the dispersion section 43 (the width of the bed-material-introduction-side wall 41) and spaced apart from each other by a constant spacing L from several to scores of centimeters. As shown in FIGS. 8-10, a partition 44 in the dispersion section 43 is provided with concave introduction sections 53 peripherally formed with introduction ports 52 for the fluidizing gas. The introduction ports 52 on the introduction section 53 may be aslant downward from within to outside. Each of the fluidizing gas introduction pipes 51 may be provided with a pressure gage or other sensor means 54 and an on/off valve or other on/off means selectively opened and closed depending upon data from the sensor means 54 to regulate a fluidized state of the bed material 11.

Substantially similar to the first embodiment, the supply section 48 comprises a plurality of supply pipes 56 arranged on a periphery of the dispersion section 43 on a side near the fluidized-bed gasification furnace 40 and spaced apart from each other by a constant spacing from scores of centimeters to several meters along the length of the section 43. The plural supply pipes 56 extend downward from the dispersion section 43, are connected to the fluidized-bed gasification furnace 40 and are spaced by a predetermined spacing along the width of the bed-material-introduction-side wall 41 throughout the width of the bed-material-introduction-side of the furnace 40.

The supply means for supplying the coal or other raw material 26 into the fluidized-bed gasification furnace 40 may be such that a raw material supply pipe or pipes (not shown) extending from a raw material feeder or the like is or are connected to the dispersion section 43 so as to supply the raw material 26 to the section 43.

Further a circulation passage 25 (see FIG. 6) leading from the fluidized-bed gasification furnace 40 to the fluidized-bed combustion furnace 1 is arranged on the bed-material-lead-out-side wall 42 of the furnace 40 opposing to the bed-material-introduction-side wall 41.

An operation of the third embodiment for the fluidized-bed gasification method and the facility therefor of the invention will be described.

When the bed material 11 is to be supplied from the separator 8 to the fluidized-bed gasification furnace 40, the bed material is introduced through the downcomer 70 into the dispersion section 43 extending along the width of the bed-material-introduction-side wall 41 of the furnace 40. The fluidizing gas is blown from the fluidizing-gas introduction means 47 into the dispersion section 43 to evenly disperse the bed material 11 in the section 43 without localized distribution of the bed material 11 due to a charged position from the downcomer 46. Then, the bed material 11 is supplied from the dispersion section 43 via the plural supply pipes of the supply section 48 into the fluidized-bed gasification furnace 40 evenly throughout the width on the bed-material-introduction side, thereby leading out the bed material 11 from the bed-material-lead-out side of the furnace 40 while reducing the lingering of the bed material 11 in the furnace 40.

In this case, in the downcomer 70, the bed material 11 is accumulated in the intermediate portions 72, 73 and 74 to form a sealing zone for pressure to prevent the burnt gas in the dispersion section 43 from flowing back over the downcomer 70, the bed material 11 overflowed from the rising intermediate portion 74 being supplied through the outlet portion 75 to the dispersion section 43.

Thus, the fluidized-bed gasification method and the facility therefor according to the third embodiment of the invention can exhibit effects and advantages substantially similar to those in the first embodiment. With the downcomer 70 comprising the intermediate portions 72, 73 and 74 for accumulation of the bed material 11 to form a sealing zone for pressure through change of an extension in direction of the separator 8 and an outlet portion 75 leading from the intermediate portion 74 to the dispersion section 43 to properly supply the bed material 11 overflowed from the intermediate portion to the section 43, the sealing zone serving to prevent the burnt gas in the dispersion section 43 from flowing back to over the downcomer 70, the bed material 11 is optimally supplied from the dispersion section 43 via the supply pipes 72, 73 and 74 and the outlet portion 75 to the furnace 40 and the bed material 11 can be caused to pass every corner of the fluidized-bed gasification furnace 40, thereby properly attaining a desired gasification amount and easily preventing the unreacted char from being discharged.

Next, a fourth embodiment of the invention will be described in conjunction with FIG. 13 where parts similar to those in FIGS. 6 and 7 are represented by the same reference numerals.

The fourth embodiment has a modification in shape of the dispersion and supply sections 43 and 48 of the first embodiment. Specifically, a dispersion section 80 of the fourth embodiment comprises a rectangular-parallelepiped passage 81 extending along the width of the bed-material-introduction-side wall 41 of the fluidized-bed gasification furnace 40 and directed downward from a vicinity above the bed-material-introduction-side wall 41. A supply section 82 of the fourth embodiment comprises a supply passage 84 between the dispersion section 80 and the fluidized-bed gasification furnace 40, having a supply port 83 extending along the width of the bed-material-introduction-side wall 41 to provide a supply passage 84 leading from above to the furnace 40. Arranged between the dispersion section 80 and the supply section 82 are a bottom communicating section 85 extending substantially horizontally from a lower end of the dispersion section 80 and a rising communicating section 86 extending upward from a tip of the bottom communicating section 85 to an upper end of the supply passage 84 of the supply section 82 to thereby provide a flow passage from the passage 81 of the dispersion section 80 to the supply passage 84 of the supply section 82 and with a width same as that of the bed-material-introduction-side wall 41. The bed material 11 is accumulated in a lower portion of the dispersion section 80 and the communicating sections 85 and 86 to form a sealing zone for pressure. The communicating sections 85 and 86 may be of any shape, providing the sealing zone for pressure is formed.

Arranged on the lower end of the dispersion section 80 are fluidizing-gas introduction means 47 for introduction of fluidizing gas into the sections 80, 85 and 86 at plural positions. The fluidizing-gas introduction means 47 comprises a plurality of fluidizing-gas introduction pipes 51 arranged along the length of the dispersion section 80 (the width of the bed-material-introduction-side wall 41) and spaced apart from each other by a constant spacing L of several to scores of centimeters to consistently fluidize the bed material 11 in the sections 80, 85 and 86. When the lower portion of the dispersion section 80 and the bottom communicating sections 85 and 86 are partitioned by a partition (not shown) to provide a wind box (not shown), the partition may be provided with, as shown in FIGS. 8-10, concave introduction sections 53 peripherally formed with fluidizing-gas introduction ports 52. The introduction ports 52 on the introduction section 53 may be aslant downward from within to outside. Each of the fluidizing-gas introduction pipes 51 may be provided with a pressure gage or other sensor means 54 and an on/off valve or other on/off means selectively opened and closed depending on data from the sensor means 54 to regulate a fluidized state of the bed material 11.

Supply means for supplying coal or other raw material 26 to the fluidized-bed gasification furnace 40 is seen in FIG. 6 with respect to the first to third embodiments; in the fourth embodiment, supply means is such that a raw material supply pipe or pipes (not shown) extending from a raw material feeder or the like and connected to the section 80, 85 or 86 at one or more positions so as to supply the raw material to the sealing zone of the sections 80, 85 and 86.

Further, a circulation passage 25 (see FIG. 6) leading from the fluidized-bed gasification furnace 40 to the fluidized-bed combustion furnace 1 is arranged on the bed-material-lead-out-side wall 42 of the furnace 40 opposing to the bed-material-introduction-side wall 41.

An operation of the fourth embodiment for the fluidized-bed gasification method and the facility therefor of the invention will be described.

When the bed material 11 is to be supplied from the separator 8 to the fluidized-bed gasification furnace 40, the bed material 11 is introduced through the downcomer 46 into the dispersion section 80 extending along the width of the bed-material-introduction-side wall 41 of the furnace 40. The fluidizing gas is blown from the fluidizing-gas introduction means 47 into a lower end of the dispersion section 80 to evenly disperse the bed material 11 in the dispersion and communicating sections 80, 85 and 86 without localized distribution of the bed material 11 due to a charged position from the downcomer 46. Then, the bed material 11 is supplied from the rising communicating section 86 via the supply passage 84 to the fluidized-bed gasification furnace 40 evenly throughout the with on the bed-material-introduction side, thereby leading out the bed material 11 from the bed-material-lead-out-side of the furnace 40 while reducing the lingering of the bed material 11 in the furnace 40.

In this case, the bed material 11 is accumulated in the dispersion and communicating sections 80, 85 and 86 to form a sealing zone for pressure so as to prevent the burnt gas in the fluidized-bed gasification furnace 40 from flowing back to over the dispersion section 80, the bed material 11 overflowed from the rising communicating section 86 being supplied via the supply passage 84 to the furnace 40.

Thus, the fluidized-bed gasification method and the facility therefor according to the fourth embodiment of the invention can exhibit effects and advantages substantially similar to those of the first embodiment. The supply section 82, which comprises the supply passage 84 with the supply port 83 extending along the width of the bed-material-introduction-side wall 41 and leads from the passage 81 of the dispersion section 80 to the fluidized-bed gasification furnace 40, further facilitates the supply of the bed material 11 to the furnace 40 evenly throughout the width on the bed-material-introduction side, so that the bed material 11 can be caused to pass every corner of the fluidized-bed gasification furnace 40, thereby properly attaining a desired gasification amount and easily preventing the unreacted char from being discharged.

Further, the communicating sections 85 and 86 are arranged between the dispersion section 80 and the supply passage 84 to provide the flow passage from the passage 81 of the dispersion section 80 to the supply passage 84 and having the width same at that of the bed-material-introduction-side wall 41. The communicating sections 85 and 86 are formed by changing the extension in direction of the dispersion section 80 to accumulate the bed material 11 between the passage 81 of the dispersion section 80 and the supply passage 84 to thereby form a sealing zone for pressure so as to prevent the burnt gas from flowing back from the fluidized-bed gasification furnace 40 to over the dispersion section 80. Thus, the bed material 11 can be favorably supplied from the passage 81 of the dispersion section 80 via the communicating sections 85 and 86 and the supply passage 84 of the supply section 82 to the fluidized-bed gasification furnace 40 to cause the bed material 11 to pass any corner of the fluidized-bed gasification furnace 40, thereby properly attaining a desired gasification amount and easily preventing unreacted char from being discharged.

Figure 13:
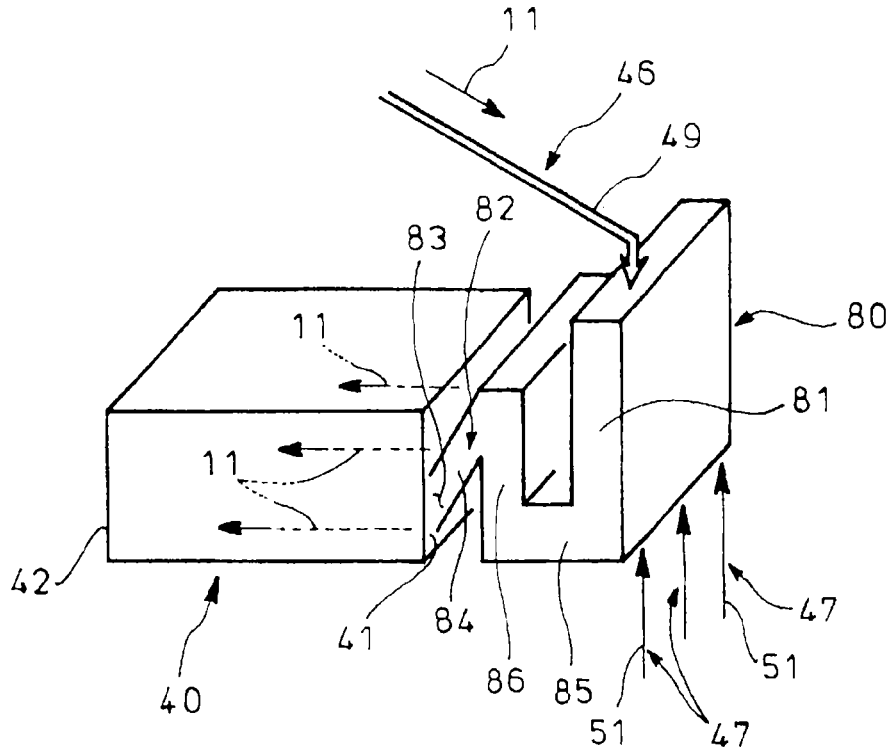
FIG. 13 is a schematic view showing flows of bed material and fluidizing gas in a fourth embodiment of the invention.
Figure 14:
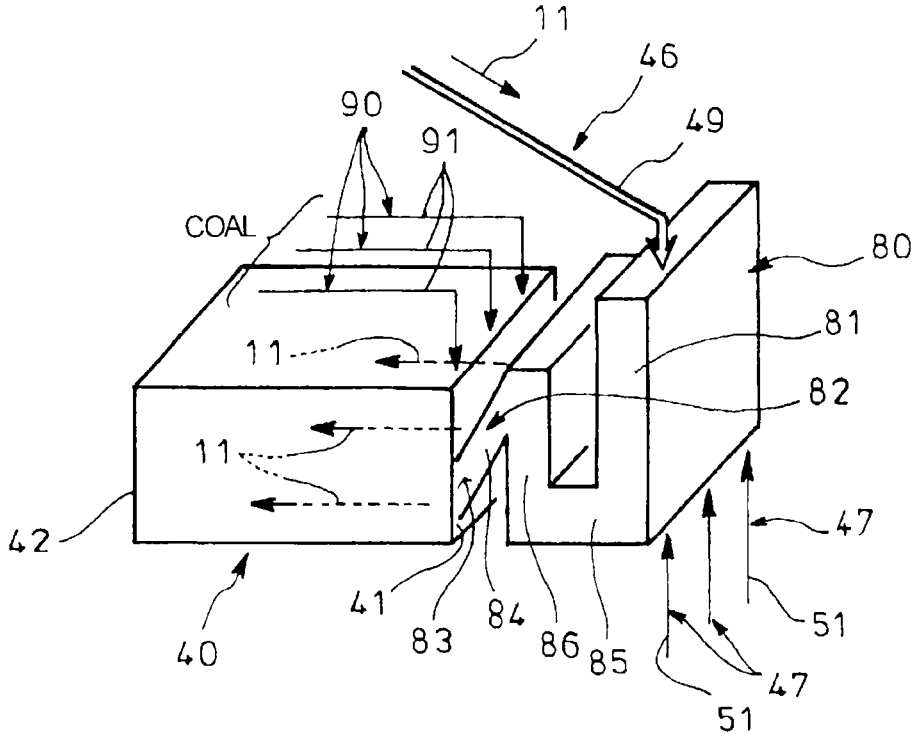
FIG. 14 is a schematic view showing introduction of raw material into a fluidized-bed gasification furnace at plural positions in a fifth embodiment of the invention.

A fifth embodiment of the invention will be described in conjunction with FIG. 14 in which parts similar to those in FIG. 13 are represented by the same reference numerals.

The fifth embodiment has a modification of coal or other raw material supply means shown in the fourth embodiment. Specifically, raw material supply means 90 comprises raw material supply pipes 91 arranged along width of a bed-material-introduction-side wall 41 and spaced by a constant spacing. A raw material is introduced by a raw material feeder or the like (not shown) through the raw material supply pipes 91 into a fluidized-bed gasification furnace 40 upstream of the flow of bed material to increase a reaction time of the raw material. The raw material supply means shown in the fifth embodiment may apply to any of the first to third embodiments.

Further, the fifth embodiment has a dispersion section 80, communicating sections 85 and 86, a supply section 82, fluidizing-gas introduction means 47 and a circulation passage 25 substantially similar to those of the fourth embodiment.

An operation of the fifth embodiment for the fluidized-bed gasification method and the facility therefor of the invention will be described.

When the bed material 11 is to be supplied from the separator 8 to the fluidized-bed gasification furnace 40, like the fourth embodiment, the bed material 11 is introduced through the downcomer 46 into the dispersion section 80 extending along the width of the bed-material-introduction-side wall 41 of the furnace 40. The fluidizing gas is blown from the fluidizing-gas introduction means 47 into the lower end of the dispersion section 80 to evenly disperse the bed material 11 into the dispersion and communicating sections 80, 85 and 86 without localized distribution of the bed material 11 due to a charged position from the downcomer 46. Then, the bed material 11 is supplied from the rising communicating section 86 via the supply passage 84 of the supply section 82 to the fluidized-bed gasification furnace 40 evenly throughout the width on the bed-material-introduction side, thereby leading out the bed material from the bed-material-lead-out side of the fluidized-bed gasification furnace 40 while reducing the lingering of the bed material 11 in the furnace 40.

The raw material supply means 90 concurrently supplies the coal or other raw material through the plural raw material supply pipes 91 into the fluidized-bed gasification furnace 40 at plural positions.

Thus, the fluidized-bed gasification method and the facility therefor according to the fifth embodiment can attain effects and advantages substantially similar to those in the fourth embodiment. When the construction is such that the raw material is introduced into the fluidized-bed gasification furnace 40 at plural positions, the raw material can be introduced in a dispersed manner into the fluidized-bed gasification furnace 40, so that a desired gasification amount can be properly attained and the unreacted char can be easily prevented from being discharged.

It is to be understood that a fluidized-bed gasification method and a facility therefor according to the invention are not limited to the above embodiments and that various changes and modifications may be made without departing from the scope of the invention. For example, any other shape and construction may be employed, providing the bed material is supplied to the fluidized-bed gasification furnace evenly throughout the width on the bed-material-introduction side. A plurality of downcomers may be provided to supply the bed material to the dispersion section.

REFERENCE SIGNS LIST

1 fluidized-bed combustion furnace
8 separator
11 bed material
25 circulation passage
26 raw material
40 fluidized-bed gasification furnace
41 bed-material-introduction-side wall
43 dispersion section
46 downcomer
47 fluidizing-gas introduction means
48 supply section
50 opening
51 fluidizing gas introduction pipe
56 supply pipe
60 supply section
61 supply pipe
62 inlet portion
63 bottom intermediate portion
64 rising intermediate portion
65 outlet portion
70 downcomer
72 lowering intermediate portion
73 bottom intermediate portion
74 rising intermediate portion
75 outlet portion
80 dispersion section
82 supply section
83 supply port
84 supply passage
85 bottom communicating section
86 rising communicating section

The invention claimed is:

1. A fluidized-bed gasification method comprising:

arranging a fluidized-bed combustion furnace where char is burned to heat a bed material;

separating hot fluid from said fluidized-bed combustion furnace by a separator into the bed material and an exhaust gas;

introducing the separated bed material through a downcomer into a dispersion section extending substantially along a width of a bed-material-introduction-side wall of a fluidized-bed gasification furnace;

blowing a fluidizing gas into the dispersion section to fluidize the bed material;

supplying the bed material in the dispersion section via a plurality of supply pipes arranged along the width of the bed-material-introduction-side wall into the fluidized-bed gasification furnace substantially evenly throughout the width on a bed-material-introduction side;

introducing a raw material into said fluidized-bed gasification furnace where the raw material is gasified in a fluidized bed fed with a gasification agent and a resultant produced gas is taken out; and circulating char produced upon the gasification of the raw material and the bed material to said fluidized-bed combustion furnace to burn the char.

2. A fluidized-bed gasification method comprising:

arranging a fluidized-bed combustion furnace where char is burned to heat a bed material;

separating hot fluid from said fluidized-bed combustion furnace by a separator into the bed material and an exhaust gas;

introducing the separated bed material through a downcomer into a dispersion section having a length extending substantially along a width of a bed-material-introduction-side wall of a fluidized-bed gasification furnace;

blowing a fluidizing gas via a plurality of fluidizing-gas introduction pipes arranged along the length of the dispersion section into the dispersion section to fluidize the bed material;

supplying the bed material in the dispersion section into the fluidized-bed gasification furnace substantially evenly throughout the width of a bed-material-introduction side;

introducing a raw material into said fluidized-bed gasification furnace where the raw material is gasified in a fluidized bed fed with a gasification agent and a resultant produced gas is taken out; and circulating char produced upon the gasification of the raw material and the bed material to said fluidized-bed combustion furnace to burn the char.

3. A fluidized-bed gasification method comprising:

arranging a fluidized-bed combustion furnace where char is burned to heat a bed material;

separating hot fluid from said fluidized-bed combustion furnace by a separator into the bed material and an exhaust gas;

introducing the separated bed material through a downcomer into a dispersion section extending substantially along a width of a bed-material-introduction-side wall of a fluidized-bed gasification furnace;

blowing a fluidizing gas into the dispersion section to fluidize the bed material;

supplying the bed material in the dispersion section into the fluidized-bed gasification furnace substantially evenly throughout the width on a bed-material-introduction side;

introducing a raw material into said fluidized-bed gasification furnace where the raw material is gasified in a fluidized bed fed with a gasification agent and a resultant produced gas is taken out; and circulating char produced upon the gasification of the raw material and the bed material to said fluidized-bed combustion furnace to burn the char, wherein the downcomer comprises an intermediate portion which accumulates the bed material for formation of a sealing zone for pressure and an outlet portion leading from the intermediate portion to the dispersion section to supply the bed material overflowed from the intermediate portion to the dispersion section, the sealing zone being configured to prevent burnt gas from flowing back from the dispersion section to over the downcomer.

* * * * *